US006020802A

United States Patent [19]

Larson et al.

[11] Patent Number: 6,020,802

[45] Date of Patent: Feb. 1, 2000

[54] CIRCUIT BREAKER INCLUDING TWO MAGNETIC COILS AND A POSITIVE TEMPERATURE COEFFICIENT RESISTIVITY ELEMENT

[75] Inventors: Brett E. Larson; William W. Chen, both of Cedar Rapids, Iowa

[73] Assignee: Square D Company, Palatine, Ill.

[21] Appl. No.: 09/054,282

[22] Filed: Apr. 2, 1998

[51] Int. Cl.[7] ..... H01H 9/00

[52] U.S. Cl. ..... 335/172; 335/35; 335/23; 335/43

[58] Field of Search ..... 335/35, 172, 8–10, 335/173, 174, 6, 23, 37, 43

[56] References Cited

U.S. PATENT DOCUMENTS

| | | | |
|---|---|---|---|
| 3,401,363 | 9/1968 | Vyskocil et al. | 335/35 |
| 3,760,310 | 9/1973 | Carson | 335/146 |
| 3,973,233 | 8/1976 | Miyamoto et al. | 337/118 |
| 4,070,641 | 1/1978 | Khalid | 338/61 |
| 4,288,769 | 9/1981 | Howell | 335/173 |
| 4,562,323 | 12/1985 | Belbel et al. | 200/151 |
| 4,596,911 | 6/1986 | Guery et al. | 200/151 |
| 4,677,266 | 6/1987 | Belbel et al. | 200/151 |
| 4,801,772 | 1/1989 | Bratkowski et al. | 200/151 |
| 5,119,054 | 6/1992 | Grunert et al. | 335/35 |
| 5,195,013 | 3/1993 | Jacobs et al. | 361/106 |
| 5,214,405 | 5/1993 | Glas | 337/71 |
| 5,254,816 | 10/1993 | Shutoh et al. | 200/144 AP |
| 5,303,115 | 4/1994 | Nayar et al. | 361/106 |
| 5,345,126 | 9/1994 | Bunch | 310/68 C |
| 5,378,938 | 1/1995 | Chandler et al. | 252/513 |
| 5,382,938 | 1/1995 | Hansson et al. | 338/22 R |
| 5,414,403 | 5/1995 | Grueter et al. | 338/22 R |
| 5,424,504 | 6/1995 | Tanaka et al. | 218/78 |
| 5,428,195 | 6/1995 | Arnold | 218/1 |
| 5,428,493 | 6/1995 | Takeuchi et al. | 361/27 |
| 5,436,609 | 7/1995 | Bauer | 338/22 R |
| 5,473,495 | 12/1995 | Bauer | 361/11 |
| 5,495,083 | 2/1996 | Aymami-Pala et al. | 218/1 |
| 5,530,613 | 6/1996 | Bauer et al. | 361/58 |
| 5,539,370 | 7/1996 | Arnold | 337/8 |
| 5,629,658 | 5/1997 | Chen | 335/201 |
| 5,667,711 | 9/1997 | Mody et al. | 219/505 |

FOREIGN PATENT DOCUMENTS

WO 91/12643 8/1991 WIPO .

*Primary Examiner*—Lincoln Donovan
*Assistant Examiner*—Tuyen T. Nguyen
*Attorney, Agent, or Firm*—Kareem M. Irfan; Larry I. Golden

[57] ABSTRACT

A circuit breaker for interrupting the flow of electric current in a line includes a switch connected in series with the line, the switch having an open position and a closed position. At least one positive temperature coefficient resistivity element (PTC element) is connected in series with the line. A first magnetic coil is positioned around a yoke, for example, an iron core, and connected in parallel with the PTC element and a second magnetic coil is positioned around the yoke and connected in series with the line and the switch. A voltage limiting device, such as a metal oxide varistor, is connected in parallel with the at least one PTC element. An armature is pivotally mounted in relation to the yoke wherein the yoke and the armature form a magnetic circuit with the first magnetic coil and the second magnetic coil. A trip lever is connected to the armature and the switch, the trip lever effecting movement of the switch from a closed position to an open position wherein the flow of electric current in the line is interrupted. When the first magnetic coil or the second magnetic coil reaches a predetermined current value, the armature is pulled to trip by the magnetic circuit wherein the trip lever is pulled to a tripped position to effect the movement of the switch to an open position wherein the flow of electric current in the line is interrupted.

10 Claims, 2 Drawing Sheets

CIRCUIT BREAKER INCLUDING TWO MAGNETIC COILS AND A POSITIVE TEMPERATURE COEFFICIENT RESISTIVITY ELEMENT

BACKGROUND OF THE INVENTION

1. Field of the Invention

This invention relates to trip mechanisms having two magnetic coils in a circuit breaker including positive temperature coefficient resistivity elements (PTC elements).

2. Description of the Related Art

A circuit breaker protects circuits not only in short circuit situations but also in overload situations. For instance, according to UL489 requirements, the circuit breaker must trip within an hour when current reaches 135% of the ampere rating of the breaker. Typically, a bimetal is used in existing circuit breakers for overload protection. The bimetal is a current carrying part in low ampere rated circuit breakers. When an overload situation occurs, the high current increases the temperature of the bimetal and the bimetal is deflected by the heat, causing the circuit breaker to trip.

Circuit breakers including bimetal must be calibrated which significantly raises the cost of manufacturing and include many other disadvantages related to using the bimetal and calibration. However, even with calibration the bimetal does not always behave consistently and a calibrated circuit breaker will not always trip at the set overload rating.

The method and apparatus of the present invention uses one or more conductive polymer elements such as a positive temperature coefficient resistivity element (PTC element) to replace the bimetal in a circuit breaker. The method and apparatus of the present invention also includes a smaller novel trip mechanism than those typically used in circuit breakers having a bimetal element, wherein the trip mechanism includes two magnetic coils on a single yoke.

SUMMARY OF THE INVENTION

The method and apparatus of the present invention discloses a circuit breaker for interrupting the flow of electric current in a line including a switch connected in series with the line, the switch having an open position and a closed position. At least one positive temperature coefficient resistivity element (PTC element) is connected in series with the line. A first magnetic coil is positioned around a yoke, for example, an iron core, and connected in parallel with the PTC element and a second magnetic coil is positioned around the yoke and connected in series with the line and the switch. The second magnetic coil provides a direct line current path for the circuit breaker. A voltage limiting device, such as a metal oxide varistor, is connected in parallel with the at least one PTC element. An armature is pivotally mounted in relation to the yoke wherein the yoke and the armature form a magnetic circuit with the first magnetic coil and the second magnetic coil. A trip lever is connected to the armature and the switch, the trip lever effecting movement of the switch from a closed position to an open position wherein the flow of electric current in the line is interrupted.

When the first magnetic coil reaches a predetermined current value from the PTC element, the armature is pulled to trip by the magnetic circuit wherein the trip lever is pulled to a tripped position to effect the movement of the switch to an open position wherein the flow of electric current in the line is interrupted. When the second magnetic coil reaches a predetermined current value from the line, the armature is pulled to trip by the magnetic circuit wherein the trip lever is pulled to a tripped position to effect the movement of the switch to an open position wherein the flow of electric current in the line is interrupted.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION OF THE PREFERRED EMBODIMENTS

Figure 1:
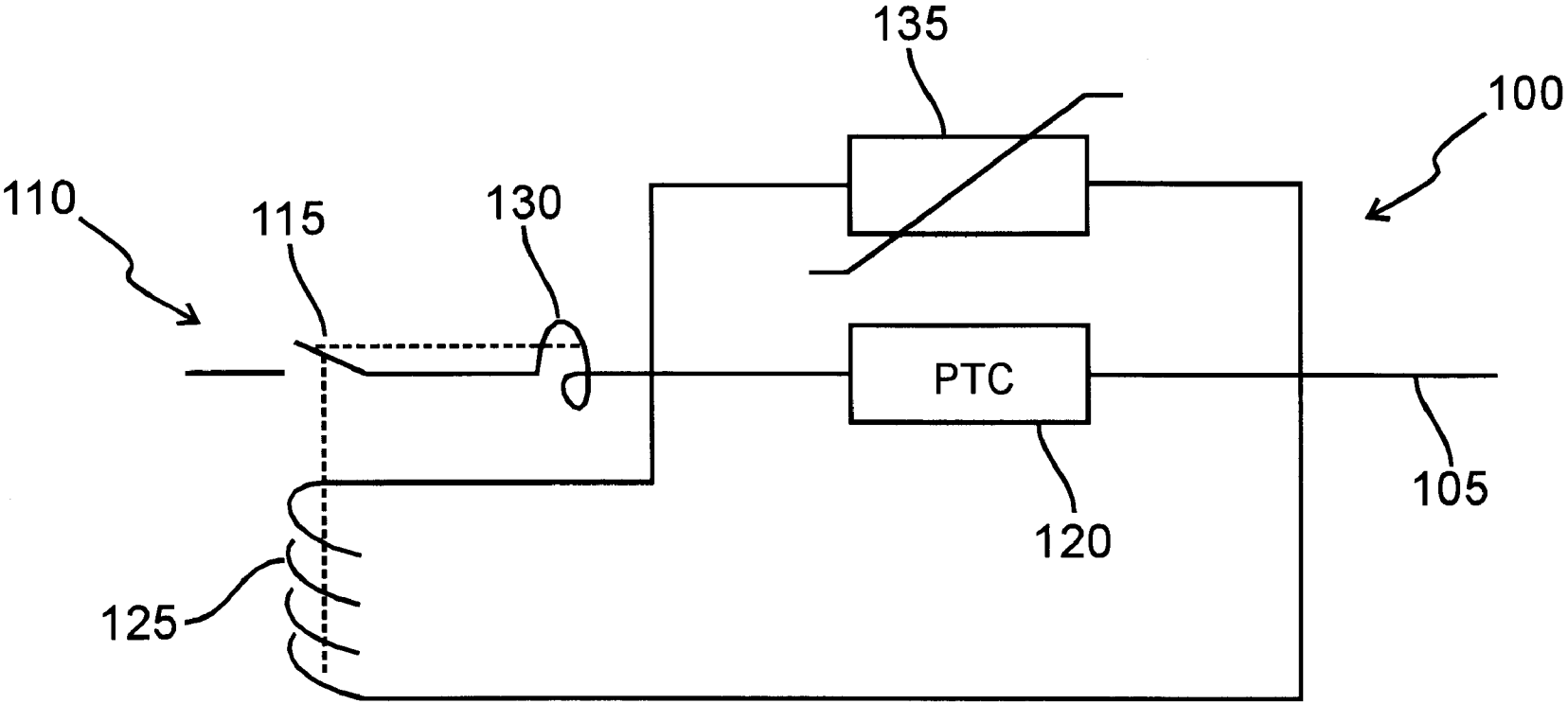
FIG. 1 illustrates a low ampere rated circuit breaker including a PTC element in accordance with the present invention.

FIG. 1 illustrates a low ampere rated circuit breaker 100 for interrupting the flow of electric current in a line 105, the circuit breaker including a trip mechanism 110 in accordance with the present invention. A switch 115 is connected in series with the line 105 wherein the switch 115 has an open position and a closed position. The open position of the switch 115 is used herein to illustrate a position of the switch 115 wherein the flow of electric current in the line 105 is interrupted and can also be described as a tripped position. At least one positive temperature coefficient resistivity element (PTC element) 120 is connected in series with the line 105. The PTC element 120 is made, for example, from conductive polymers, ceramic $BaTiO_3$, or any other PTC material having a resistivity greater than 0.1 ohm.cm at room temperature, such as manufactured by Raychem or Bourns. Preferably, the PTC element 120 is a PTC element having a reduced current and resistivity tolerance level according to co-pending U.S. patent application, Ser. No. 09/054,153, filed Apr. 2, 1998, entitled "Circuit Breaker Including Positive Temperature Coefficient Resistivity Elements Having A Reduced Tolerance", filed concurrently herewith. The PTC element 120 provides an activating signal to a first magnetic coil 125 connected in parallel with the PTC element 120. The activating signal is, for example, a predetermined current or voltage level wherein the first magnetic coil 125 is energized. The circuit breaker 100 is unlatched to open the switch 115 by the first magnetic coil 125 connected in parallel with the PTC element 120, for example, during a small overload such as 135% and 200% of the ampere rating of the circuit breaker. The resistance of the first magnetic coil 125 is larger than that of the PTC element 120 at room temperature.

Under normal operations, most of the current in the circuit breaker 100 passes through the PTC element 120 instead of the first magnetic coil 125. The first magnetic coil 125 is energized to unlatch the circuit breaker 100 and trip the switch 115 whenever the voltage across the PTC element 120 and the current through the PTC element 120 reaches a certain value. During an overload, high current flowing through the PTC element 120 heats the PTC element 120 and the resistance of the PTC element 120 increases sharply as the temperature increases over a threshold. The voltage across the PTC element 120 will reach the predetermined value, and thus energize the first magnetic coil 125. The thermal properties of a PTC element largely depend on the resistance and mass of the PTC element. Therefore, the resistance and/or mass of the PTC element 120 are used to screen the PTC element for a particular circuit breaker.

A second magnetic coil 130 is connected in series with the line 105 and the switch 115 providing a direct line current path. If the current through the circuit breaker 100 reaches a value higher than a predetermined value such as, for example, about 500% of the ampere rating, the second magnetic coil 130 produces a magnetic force strong enough to unlatch the circuit breaker 100 instantaneously. The PTC element 120 is shunted by one or more voltage limiting devices, such as a metal oxide varistor 135 (MOV element), connected in parallel with the PTC element 120. The metal oxide varistor 135 provides a shunt path for the extra current during a high interruption wherein the PTC element 120 is protected from breaking down. Two or more PTC elements (not shown) may also be connected to the line 105 wherein the ampere rating of the circuit breaker 100 is increased.

Figure 2:
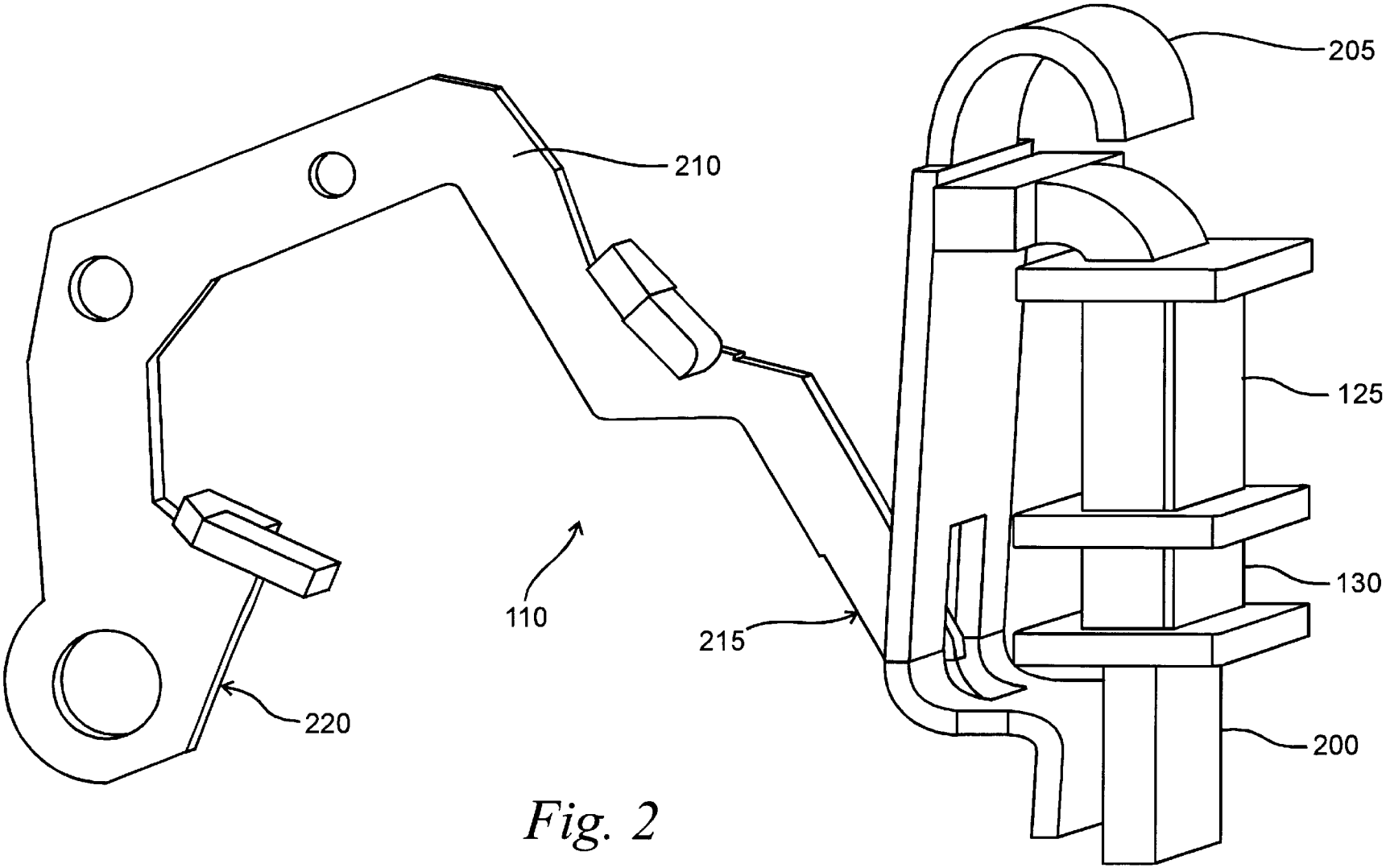
FIG. 2 is an exploded perspective view of the trip mechanism including a magnetic yoke and armature used within the circuit breaker.

The trip mechanism 110 including the first magnetic coil 125 and the second magnetic coil 130 is further illustrated in an exploded perspective view of the trip mechanism in FIG. 2. The trip mechanism 110 includes a yoke 200 such as an iron core having the first magnetic coil 125 and the second magnetic coil 130 on the single yoke 200. The first magnetic coil 125 is positioned around the yoke 200 and connected in parallel with the PTC element 120 and the second magnetic coil 130 is positioned around the yoke 200 and connected in series with the line 105 and the switch 115 providing a direct line current path. The first magnetic coil 125 is a series coil having, for example, two wraps around the yoke 200, and the second magnetic coil 130 includes numerous wraps around the yoke 200.

An armature 205 is pivotally mounted in relation to the yoke 200 wherein the yoke 200 and the armature 205 form a magnetic circuit with the first magnetic coil 125 and the second magnetic coil 130. The armature 205 is mounted, for example, on a circuit breaker base (not shown) in relation to the yoke 200, or, for example, directly mounted on the yoke 200 as illustrated in FIG. 2. A first end 215 of a trip lever 210 is connected to the armature 205. The trip lever 210 is also connected at a second end 220 to the switch 115 in accordance with conventional circuit breaker design (not shown in FIG. 2). The trip lever 210 effects movement of the switch 115 from a closed position to an open position wherein the flow of electric current in the line is interrupted. Other breaker components are not shown in the exploded perspective view of FIG. 2. The trip lever 210 is reduced in size relative to trip levers typically used in low ampere circuit breakers using bimetal.

When the first magnetic coil 125 reaches a predetermined current value from the PTC element 120, the armature 205 is pulled to trip by the magnetic circuit wherein the trip lever 210 is pulled to a tripped position to effect the movement of the switch 115 to an open position wherein the flow of electric current in the line 105 is interrupted. When the second magnetic coil 130 reaches a predetermined current value of the line 105 current, the armature 205 is pulled to trip by the magnetic circuit wherein the trip lever 210 is pulled to a tripped position to effect the movement of the switch 115 to an open position wherein the flow of electric current in the line is interrupted.

When the switch 115 is in the closed position, an air gap forms at the ends of the yoke 200 and the armature 205. The armature 205 is spring loaded (not shown) to provide a force for moving the armature 205 back to form an air gap between the armature 205 and the yoke 200 when the circuit breaker 100 is in a closed position. The circuit breaker 100 trips when the armature 205 is pulled to close the air gap at the ends of the yoke 200. The armature 205 is pulled to trip the circuit breaker 100 by magnetic force when the current in either the first magnetic coil 125 or the second magnetic coil 130 reaches a predetermined value as described above. The switch 115 is biased to an open position after the circuit breaker 100 trips.

The method and apparatus of the present invention eliminates the use of bimetal and the need for calibration of circuit breakers, so that the problems and costs related to calibration of circuit breakers is eliminated. The present invention also provides for two magnetic coils on one yoke and a reduced size trip lever wherein the overall size of the trip mechanism is reduced. The design and manufacture of the magnetic trip mechanism without the requirement of integrating thermal trip elements such as bimetal elements allows for the elimination of stamped and formed parts and the use of molded features. Molded features are typically more precise and repeatable than stamped and formed parts. When the PTC element having a reduced tolerance according to the present invention is connected in series in the main circuit for a low ampere circuit breaker, the PTC element provides much better current limiting than existing circuit breakers using a bimetal during a short circuit interruption.

In addition, up to 100% interruption energy is converted into the heat of PTC/MOV rather than in generating arc and pressure as in existing circuit breakers. Almost 100% interruption energy goes into arcing in existing circuit breakers. In the present invention, up to 100% interruption energy is transferred into PTC and MOV elements, so that the arcing energy is effectively reduced in a low ampere circuit breaker.

While preferred embodiments have been shown and described, various modifications and substitutions may be made thereto without departing from the spirit and scope of the invention. Accordingly it is to be understood that the present invention has been described by way of illustrations and not limitations.

What is claimed is:

1. A circuit breaker for interrupting the flow of electric current in a line comprising:

a switch connected in series with the line, the switch having an open position and a closed position;

at least one positive temperature coefficient resistivity element (PTC element) connected in series with the line;

a yoke;

a first magnetic coil positioned around the yoke and connected in parallel with the PTC element;

a second magnetic coil positioned around the yoke and connected in series with the line and the switch, providing a direct line current path for the circuit breaker;

a voltage limiting device connected in parallel with the at least one PTC element;

an armature pivotally mounted in relation to the yoke wherein the yoke and the armature form a magnetic circuit with the first magnetic coil and the second magnetic coil; and a trip lever connected to the armature and the switch, the trip lever effecting movement of the switch from a closed position to an open position wherein the flow of electric current in the line is interrupted.

2. A circuit breaker, as recited in claim 1, wherein the armature is directly mounted on the yoke.

3. A circuit breaker, as recited in claim 1, wherein the armature is mounted on a circuit breaker base in relation to the yoke.

4. A circuit breaker, as recited in claim 1, wherein the yoke is an iron core.

5. A circuit breaker, as recited in claim 1, wherein the at least one PTC element has a reduced current and resistance tolerance level.

6. A circuit breaker, as recited in claim 1, wherein, when more than one PTC element is connected to the line, the more than one PTC elements are connected to each other in parallel.

7. A circuit breaker, as recited in claim 1, wherein the voltage limiting device is a metal oxide varistor.

8. A trip mechanism used for a circuit breaker for interrupting the flow of electric current in a line, the circuit breaker including at least one PTC element, the trip mechanism comprising:

an iron core;

a first magnetic coil positioned around the iron core and connected in parallel to the PTC element;

a second magnetic coil positioned around the iron core and connected in series with the line providing a direct line current path for the circuit breaker;

an armature pivotally mounted in relation to the iron core wherein the iron core and the armature form a magnetic circuit with the first magnetic coil and the second magnetic coil; and a trip lever connected to the armature, the trip lever effecting change of the circuit breaker from a closed position to an open position wherein the flow of electric current in the line is interrupted.

9. A trip mechanism, as recited in claim 8, wherein the armature is directly mounted on the yoke.

10. A trip mechanism, as recited in claim 8, wherein the armature is mounted on a circuit breaker base in relation to the yoke.

* * * * *